US010446002B2

(12) United States Patent
Miettinen et al.

(10) Patent No.: US 10,446,002 B2
(45) Date of Patent: Oct. 15, 2019

(54) ELECTRONIC ARTICLE SURVEILLANCE TAG

(71) Applicant: Noccela Oy, Turku (FI)

(72) Inventors: Riku Tapio Miettinen, Turku (FI); Heikki Tapani Talvitie, Littoinen (FI)

(73) Assignee: Noccela Oy, Turku (FI)

( * ) Notice: Subject to any disclaimer, the term of this patent is extended or adjusted under 35 U.S.C. 154(b) by 0 days.

(21) Appl. No.: 16/069,682

(22) PCT Filed: Feb. 9, 2017

(86) PCT No.: PCT/FI2017/050073

§ 371 (c)(1),
(2) Date: Jul. 12, 2018

(87) PCT Pub. No.: WO2017/137663

PCT Pub. Date: Aug. 17, 2017

(65) Prior Publication Data

US 2019/0027009 A1 Jan. 24, 2019

(30) Foreign Application Priority Data

Feb. 9, 2016 (FI) ..... 20165092

(51) Int. Cl.
*G08B 13/14* (2006.01)
*G08B 13/24* (2006.01)

(52) U.S. Cl.
CPC ..... *G08B 13/2434* (2013.01); *G08B 13/1463* (2013.01)

(58) Field of Classification Search
CPC ..... G08B 13/2434; G08B 13/00; G08B 13/2451; E05B 73/0017; E05B 45/06
(Continued)

(56) References Cited

U.S. PATENT DOCUMENTS 5,610,587 A 3/1997 Fujiuchi et al.
5,656,996 A 8/1997 Houser
(Continued)

FOREIGN PATENT DOCUMENTS

EP 1063627 A2 12/2000
EP 2808835 A1 * 12/2014 ..... G06Q 10/087
(Continued)

OTHER PUBLICATIONS

International search report of PCT/FI2017/050073 issued by European Patent Office dated Jun. 6, 2017.
(Continued)

*Primary Examiner* — Toan N Pham
(74) *Attorney, Agent, or Firm* — Berggren LLP

(57) ABSTRACT

The present invention relates to an electronic article surveillance tag that comprises a body provided with a battery compartment for holding a battery. The body comprises a first opening through which an end of a first pin can be inserted inside the body and releasably locked therein by a first locking mechanism. The electronic article surveillance tag further comprises a slidable cover for closing the battery compartment. The slidable cover comprises a second opening that is aligned with the first opening when the slidable cover is in a closed position. The present invention also relates to an alarm system for a facility (105).

15 Claims, 15 Drawing Sheets

(58) Field of Classification Search
USPC ..... 340/572.8, 572.1, 572.9, 568.1, 571
See application file for complete search history.

(56) References Cited

U.S. PATENT DOCUMENTS

| | | | | |
|---|---|---|---|---|
| 6,731,212 | B2 | 5/2004 | Hirose | |
| 9,251,679 | B2 * | 2/2016 | Wandel | E05B 73/0017 |
| 9,336,665 | B2 * | 5/2016 | Yang | G08B 13/14 |
| 2002/0158762 | A1 | 10/2002 | Nguyen | |
| 2005/0179548 | A1 | 8/2005 | Kittel et al. | |
| 2005/0231365 | A1 | 10/2005 | Tester et al. | |
| 2005/0264424 | A1 * | 12/2005 | Holmgren | E05B 73/0017 340/572.9 |
| 2008/0303670 | A1 * | 12/2008 | Seidel | G08B 13/06 340/572.1 |
| 2009/0135014 | A1 | 5/2009 | Bleckmann et al. | |
| 2011/0253790 | A1 * | 10/2011 | Day | E05B 73/0017 235/487 |
| 2013/0147625 | A1 | 6/2013 | Sayegh | |
| 2013/0229975 | A1 | 9/2013 | Zainaldin | |
| 2014/0240088 | A1 | 8/2014 | Robinette et al. | |
| 2015/0048947 | A1 | 2/2015 | Yang | |
| 2015/0154847 | A1 | 6/2015 | Oliver et al. | |

FOREIGN PATENT DOCUMENTS

| | | | |
|---|---|---|---|
| WO | 0016284 | A1 | 3/2000 |
| WO | 2006076348 | A2 | 7/2006 |

OTHER PUBLICATIONS

Finnish Patent Office, Search report of FI20165092 dated May 25, 2016.

* cited by examiner

ELECTRONIC ARTICLE SURVEILLANCE TAG

PRIORITY

This application is a U.S. national application of the international application number PCT/FI2017/050073 filed on Feb. 9, 2017 and claiming priority of Finnish national application number FI20165092 filed on Feb. 9, 2016 the contents of both of which are incorporated herein by reference.

TECHNICAL FIELD OF THE INVENTION

The present invention relates to an electronic article surveillance tag according to the preamble of the appended independent claim.

BACKGROUND OF THE INVENTION

In this technological advanced era, most of the retailers deploy electronic article surveillance (EAS) systems in their stores. These EAS systems are used for inventory control and to prevent theft and similar unauthorized removal of articles from a controlled area in a store. Most of these EAS systems utilize a common feature of affixing an EAS tag to an article to be protected against theft from a controlled area. When a legitimate purchase of the article is made, the EAS tag can either be removed from the article, or converted from an activated state to a deactivated state. These EAS systems employ a detection arrangement, commonly placed at all exits of the store. If an activated EAS tag passes through the detection system, it is detected by the detection system and an alarm is triggered.

Most of these EAS tags are effective in a manner that a shoplifter finds it difficult to remove it within the store. One such common and commercially viable EAS tag uses a pin based attaching element. These EAS tags include a body and a pin that is inserted into the body. The body contains a securing lock that prevents removal of the pin (when inserted) unless opened. Opening is typically done with a strong magnet. Another such common and commercially viable EAS tag uses a lanyard wire with a pin as an attaching element. The lanyard has a first end and a second end. In general, the second end is connected to a printed circuit board of the EAS tag. The first end has a pin. The pin can be inserted to the EAS tag and be removed with the use of a magnet.

Both these type of EAS tags and other similar EAS tags are used to protect different types or sets of products and have their respective advantages and disadvantages when used for different sets of products. For example, as the length of the lanyard is fixed during the manufacturing of the EAS tags having the lanyard wire, a merchant has no means for adjusting the length of the lanyard. The merchant may not be able to use EAS tags having the limited lanyard wire length for all the products in the store. Similarly, owing to the limitations of EAS tags using the pin based attaching element, the merchant may not be able to use these EAS tags for all the products.

In light of the above discussion, there is a need for an EAS tag that can be used for both the pin based attaching element and the lanyard wire with a pin as an attaching element. Further, the EAS tag should improve the anti-theft mechanisms.

EAS tags provided with a battery for supplying power to the EAS tag are known in the prior art. Most of these EAS tags comprise a detachable housing part, which enables the replacement of the battery when needed. A problem associated with these EAS tags is that there is no means to prevent an unauthorized removal of the battery, especially in situations where the EAS tag is in use, i.e. attached to a product or an article to be protected.

OBJECTIVES OF THE INVENTION

It is the main objective of the present invention to reduce or even eliminate the prior art problems presented above.

It is an objective of the present invention to provide an electronic article surveillance tag that can be used for both a pin based attaching element and a lanyard with a pin as an attaching element. It is also an objective of the invention to provide an electronic article surveillance tag that can easily be attached to different types of articles.

It is an objective of the present invention to provide an electronic article surveillance tag in which a battery can be replaced easily and in which the removal of a battery is prevented when the electronic article surveillance tag is attached to an article to be protected.

In order to realise the above-mentioned objectives, the electronic article surveillance tag according to the invention is characterised by what is presented in the characterising part of the appended independent claim. Advantageous embodiments of the invention are described in the dependent claims.

DESCRIPTION OF THE INVENTION

A typical electronic article surveillance tag according to the invention comprises a body provided with a battery compartment for holding a battery, the body comprising a first opening through which an end of a first pin can be inserted inside the body and releasably locked therein by a first locking mechanism. A typical electronic article surveillance tag according to the invention further comprises a slidable cover for closing the battery compartment, the slidable cover comprising a second opening that is aligned with the first opening when the slidable cover is in a closed position.

The electronic article surveillance tag according to the invention can be used to prevent theft and similar unauthorized removal of articles from a controlled area in a store. The electronic article surveillance tag is attached to an article to be protected by using a locking fastener or an attaching element that comprises a pin. The electronic article surveillance tag has preferably an alarm function.

The end of the first pin can be inserted through the first opening inside the body and releasably locked therein with the first locking mechanism. The first locking mechanism is attached inside the body, and it can be, for example, a magnetic lock. When the slidable cover is in the closed position, the first pin that is inserted through the first opening into the body also passes through the second opening that is aligned with the first opening. By the expression that the second opening is aligned with the first opening it is meant that the openings are arranged in such a manner that the first pin can be inserted through both of them. The first pin that has been inserted through the first and second openings into the body prevents the removal of the slidable cover from the body, and thus it prevents an unauthorized removal of the battery when the electronic article surveillance tag is attached to an article to be protected.

The battery compartment is intended for holding a battery that supplies power to the electronic article surveillance tag.

The battery compartment has an opening that is defined by the body. The opening of the battery compartment can be closed with the slidable cover that is preferably arranged to be slidable along rails or grooves in the body. In the closed position of the slidable cover, the slidable cover covers the opening of the battery compartment.

The first opening and the second opening can have different shapes and sizes. The first and second openings can be, for example, round holes, which are essentially concentric when the slidable cover is in the closed position. The second opening can be an elongate opening that extends from the edge towards the center of the slidable cover in a direction perpendicular to the movement direction of the slidable cover.

An advantage of the electronic article surveillance tag according to the invention is that the battery can be replaced easily and quickly, and that the removal of the battery is prevented when the electronic article surveillance tag is attached with a pin to an article to be protected. When the slidable cover is not locked with a pin to the body the slidable cover can be opened and closed enabling the battery to be replaced easily and quickly. When the slidable cover is locked with a pin to the body, the pin prevents the movement of the slidable cover so that the battery cannot be removed from the battery compartment.

According to an embodiment of the invention the body comprises a third opening through which an end of a second pin can be inserted inside the body and releasably locked therein by a second locking mechanism, and the slidable cover comprises a fourth opening that is aligned with the third opening when the slidable cover is in a closed position.

The end of the second pin can be inserted through the third opening inside the body and releasably locked therein with the second locking mechanism. The second locking mechanism is attached inside the body, and it can be, for example, a magnetic lock. When the slidable cover is in the closed position, the second pin that is inserted through the third opening into the body also passes through the fourth opening that is aligned with the third opening. By the expression that the fourth opening is aligned with the third opening it is meant that the openings are arranged in such a manner that the second pin can be inserted through both of them. The second pin that has been inserted through the third and fourth openings into the body prevents the removal of the slidable cover from the body, and thus it prevents an unauthorized removal of the battery when the electronic article surveillance tag is attached to an article to be protected.

The third opening and the fourth opening can have different shapes and sizes. The third and fourth openings can be, for example, round holes, which are essentially concentric when the slidable cover is in the closed position. The fourth opening can be an elongate opening that extends from the edge towards the center of the slidable cover in a direction perpendicular to the movement direction of the slidable cover.

The electronic article surveillance tag can be attached to an article, for example, with one or more separate pin based attaching elements. When only one pin based attaching element is used, it can be inserted into either the first or the third opening. It is, however, preferable to insert pin based attaching elements into both the first and the third opening in order to attach the electronic article surveillance tag firmly to the article so that the article, such as a garment, can be protected from being damaged. The electronic article surveillance tag can also be attached to an article, for example, with a lanyard that comprises pins at its ends. The electronic article surveillance tag can be attached to the article by threading the lanyard in place and then inserting the pins of the lanyard into the first and the third opening in the tag body. The locking fastener may also be a metallic, rigid object formed to the required form. This would be suitable, for example, when a large number of identical objects need to be protected.

The electronic article surveillance tag having the first and the third opening can easily be attached to different types of articles. This is possible due to the two openings in the body of the electronic article surveillance tag, which allow the electronic article surveillance tag to be attached to the article in different ways using both separate pin based attaching elements as well as a lanyard. Because the electronic article surveillance tag is provided with releasable locking mechanisms, the attachment of the electronic article surveillance tag to the article using a lanyard is easy, as this allows placing the lanyard before the pins of the lanyard are inserted into the first and the third opening of the electronic article surveillance tag. The use of releasable locking mechanisms also enables using lanyards of different length with the same electronic article surveillance tag. It also enables to replace a damaged lanyard with a new lanyard without changing the electronic article surveillance tag.

The locking mechanism may comprise a plurality of balls supported by a ball cage for releasably locking a pin, a cone shaped cup arranged in contact with the plurality of balls, and a spring for supporting the ball cage into the cone shaped cup. The locking mechanism may also comprise a conductive element having a first end and a second end, the first end being arranged in contact with the cone shaped cup and the second end being arranged in contact with a contact element inside the electronic article surveillance tag for conducting electrical current between the pin and the contact element. The conductive element may be, for example, a spring or a wire, which ensures the contact between the cone shaped cup and the contact element. When a pin is inserted into the locking mechanism, the pin pushes the ball cage slightly down. The balls can then encircle the pin and the spring supports the ball cage in the cone shaped cup to maintain the contact between the cone shaped cup, the balls and the pin. To release the pin from the opening, a special release device, for example, a strong magnet is applied to the back of the opening. The magnetically attractable ball cage is pulled partially from the cone shaped cup and the balls are moved into an area of the cone shaped cup where the space is available between the balls and the pin. This allows the pin to be withdrawn from the opening.

The present invention also relates to an electronic article surveillance tag having an alarm function. The electronic article surveillance tag comprises a body having a first opening for receiving a first pin and a second opening for receiving a second pin. The first opening is provided with a first locking mechanism for releasably locking the first pin in the first opening and the second opening is provided with a second locking mechanism for releasably locking the second pin in the second opening. The body comprises a slidable battery cover having at least one through-hole through which a pin can be inserted into the locking mechanism. The pin that has been inserted via the through-hole into the locking mechanism prevents the slidable battery cover from being detached from the body and thus it prevents an unauthorized removal of a battery from the electronic article surveillance tag. The battery cover is preferably arranged to be slidable along rails or grooves in the body. The battery cover may comprise two through-holes through which pins can be inserted to both the first and second locking mechanisms.

According to an embodiment of the invention the electronic article surveillance tag comprises means for detecting whether the first locking mechanism is locked to the first pin and/or the second locking mechanism is locked to the second pin.

According to an embodiment of the invention the electronic article surveillance tag comprises a first pin lockable to the electronic article surveillance tag with the first locking mechanism and/or a second pin lockable to the electronic article surveillance tag with the second locking mechanism. The first pin and/or the second pin can be parts of separate pin based attaching elements. Alternatively, the first pin and the second pin can be parts of a lanyard.

According to an embodiment of the invention the first locking mechanism and the second locking mechanism are electrically coupled to each other via an electrical coupling within the body, the electrical coupling being configured to detect if electrical current can be conveyed outside the body from one locking mechanism to the other.

The electrical coupling can be used to detect whether a lanyard is properly connected to the electronic article surveillance tag or not. When the lanyard is undamaged and its pins are locked into the locking mechanisms, electrical current can be conveyed from one locking mechanism to the other. If at least one of the pins is detached from the locking mechanism and/or the lanyard is cut, electrical current cannot be conducted from one locking mechanism to the other through the lanyard. The electrical article surveillance tag according to this embodiment is able to detect if the lanyard used to attach the tag to an item is broken. The tag is also able to detect if it has been detached from an item in an unauthorised manner and furthermore, in some embodiments, where the detaching has taken place.

The electrical coupling may comprise conductive elements, each of which is arranged in connection with the locking mechanism and configured to be in contact with a pin of a lanyard that has been inserted into the locking mechanism. The electrical coupling may also comprise a microcontroller that is connected with wires to the conductive elements. The microcontroller is configured to monitor whether a connection can be made via the lanyard.

According to an embodiment of the invention the electronic article surveillance tag comprises a lanyard having a first pin at its first end and a second pin at its second end, the first pin being lockable to the electronic article surveillance tag with the first locking mechanism, and the second pin being lockable to the electronic article surveillance tag with the second locking mechanism.

According to an embodiment of the invention the lanyard comprises a conducting wire having an inner conductor that is electrically connected to the first and second pins. The first end of the inner conductor is connected to the first pin and the second end of the inner conductor is connected to the second pin.

According to an embodiment of the invention the conducting wire comprises an outer conductor arranged around the inner conductor, the outer conductor being electrically isolated from the inner conductor and the first and second pins. The inner conductor is surrounded by a tubular insulating layer, which is surrounded by the outer conductor that is also tubular. The outer conductor is surrounded by an insulating outer sheath. The use of a coaxial wire in a lanyard makes it difficult to cut the lanyard without the cutting being detected. The reason for this is that it is difficult or even impossible to couple a bypass wire to the inner conductor without coupling the inner conductor through the bypass wire to the outer conductor. This coupling causes measurable changes in the electrical current that is conveyed through the lanyard.

According to an embodiment of the invention at least one of the pins of the lanyard is bent at an angle of 80 to 100 degrees. The bent pin has an advantage that it prevents the pin to inconveniently stick out from the EAS tag. A lanyard having bent pins allows the lanyard to better follow the shape of the surface of an EAS tag so that the EAS tag is as imperceptible as possible, for example, when a garment provided with the EAS tag is tried on. The use of a pin that has been bent to an essentially right angle reduces the total thickness of the electronic article surveillance tag. Thus, it is preferable to use these bent pins in situations where the electronic article surveillance tag must be attached to tight spaces. The bent pin also reduces the risk of the electronic article surveillance tag from being damaged because the bent pin is less vulnerable to external impacts. Preferably, both of the pins of the lanyard are bent at angle of 80 to 100 degrees.

According to an embodiment of the invention the electronic article surveillance tag comprises means for sensing a magnetic field. According to another embodiment of the invention the means for sensing a magnetic field is selected from the group consisting of a reed relay and a magnetometer. Also any other similar mechanisms presently known in the art can be used. The EAS tag may be a hard reusable EAS tag and it can be made of any suitable material, such as plastic.

According to an embodiment of the invention the electronic article surveillance tag comprises means for communicating with a location system, means for allowing deactivation of an alarm function, and means for initiating an alarm.

According to an embodiment of the invention the means for communicating comprise a radio communication module. The radio communication module can be, for example, a Bluetooth low energy module or a radio module using ultra wide band technology. The EAS tag may thus communicate via any appropriate communication means presently known in the art. The EAS tag can thus have a radio frequency transmitter or any other suitable signal transmission means presently known in the art. The EAS tag may optionally also comprise a radio frequency receiver. The facility in which the EAS tag is used can have at least one base station, such as one, two, three, four or five base stations. The base stations receive the signals transmitted by the EAS tag and these signals enable determination of the location of the EAS tag attached to the article. In other words, the location of the article is determined by utilizing the signals transmitted by the EAS tag. The base stations can be used in association with a location system and a monitoring system, and together they can communicate the location via a router to a server system over a communication network. The server system may include a database for storing business rules, locations, history, videos from surveillance cameras, and the like.

According to an embodiment of the invention the means for allowing deactivation of the alarm function comprise an authorisation mechanism for deactivating the alarm function. According to another embodiment of the invention the means for initiating an alarm comprise a sound source for making an alarm. The EAS tag can, for example, include a microcontroller for controlling the operation of the EAS tag, a battery for providing electricity for the EAS tag, a sound source for making an alarm, and a radio communication (such as Bluetooth low energy (BLE) or ultra wide band) module for communication and location purposes. An EAS tag may also comprise a local communication means such as radio frequency identifier (RFID) and a reed relay for detecting magnetic field in proximity of the EAS tag. It is of course also possible to use the present device in connection with existing alarm systems, such as alarm systems where sound sources are provided (for example as a security gate). In this description, triggering an alarm denotes the action of raising an alarm, whereas alarm activation denotes the action of attaching an EAS tag to an item and activating the tag such that it may trigger an alarm if need be.

According to an embodiment of the invention a location system inside a facility communicates with the electronic article surveillance tag for checking the location of the electronic article surveillance tag if a reed relay of the electronic article surveillance tag detects change in the magnetic field or if the electrical coupling senses that the electrical connection is broken. The location system may also be a location system not limited to the inside of the facility.

The present invention also relates to an electronic article surveillance tag having an alarm function, which electronic article surveillance tag comprises a body having a first opening for receiving a first pin and a second opening for receiving a second pin. The first opening is provided with a first locking mechanism for releasably locking the first pin in the first opening and the second opening is provided with a second locking mechanism for releasably locking the second pin in the second opening. The body comprises a battery cover having at least one through-hole through which a pin can be inserted into the opening. The pin that has been inserted into the opening prevents the battery cover from being detached from the body and thus it prevents an unauthorized removal of batteries from the electronic article surveillance tag. The battery cover is preferably arranged to be slidable along rails or grooves in the body. The battery cover may comprise two through-holes through which pins can be inserted to both the first opening and the second opening.

According to an embodiment of the invention the first opening and the second opening of the body of the EAS tag are electrically coupled via a conducting wire. When a conducting wire is used, the ends of the wire act as pins that can be directly inserted into the openings. The diameter of the wire is preferably essentially identical to the diameter of the opening. The wire can be made of an electrically conductive material such as metal, and be coated with an electrically insulating material except for its ends. According to an embodiment of the invention the main part of such wire is coated with an electrically insulating material (such as plastic), and only the ends of the wire are exposed (in order to allow the electrical coupling).

The present invention also relates to an alarm system for a facility. A typical alarm system according to the invention comprises at least one electronic article surveillance tag, a location system of the facility and at least one alarm device. In a typical alarm system according to the invention the location system of the facility comprises means for communicating with the electronic article surveillance tag, and the at least one alarm device is selected from the group consisting of a silent alarm device and an audible alarm device.

The location system may be such that it is able to locate the tag precisely, using xyz-coordinates, or it may be approximate, i.e. able to locate the tag within a certain radius of an antenna or similar. The radius may be, for example, 2 to 5 meters.

The alarm system may be used in facilities such as in a shopping complex, a retail chain, a merchandise store, a shop, an office store or any other facility which requires inventory control and prevention of theft or unauthorized removal of articles.

The concerned person(s) of the shop or other facility can access the server system mentioned above by using their communication devices, which include but are not limited to a laptop and a mobile phone. The concerned person can be an owner of the facility, a supervisor of the facility, a manager of the facility, and the like. In an example, if the EAS tag is removed from the article, the information is communicated to the server system. If the removal is done in an allowed place such as by the cash register, the removal does not trigger an alarm. If the removal is done outside of allowed areas and/or if a personnel tag is not close enough, the alarm is triggered. In addition, if the article and the EAS tag are moved to a non-allowed area (e.g. outside the facility), an alert alarm is initiated.

According to an embodiment of the invention the EAS tag is a sensor tag that is affixed to the article which is to be detected in such a way that it cannot be easily removed by a customer in the facility. Usually, the alarm system depends upon the feature that the attachment mechanism is constructed such that it can only be removed by the use of a specialized tool which is only in the possession of the store personnel at the checkout register or exit port for the facility or shop. In the event that an EAS tag is not removed from a protected article prior to exiting the facility, an alarm is triggered. The alarm is not triggered when the EAS tag is removed from the article in a first authorised area. The first authorised area is an allowed area inside the facility where the removal of the EAS tag is allowed. The authorised area can be a cash register area, defect control area, a store room, and the like. There can naturally be multiple authorised areas in one facility. The alarm is triggered when the EAS tag is removed from the article in a second area. The second area may be an area inside the trial rooms, or any other area where the removal of EAS tag is not allowed, and there may be multiple second areas in a facility and with respect to a facility. The tag may also be configured to trigger an alarm if the EAS tag is taken outside a third area, such as outside the area of the facility, irrespective of whether the tag is removed or not.

In an embodiment of the invention one or more antennas are placed at the exits and/or entrances to the facility. These antennas set up zones, sometimes referred to as interrogation zones, in which the EAS tag may be sensed. At least one antenna may serve the function of sending out what is called an interrogation signal. The EAS tag on the article is then affected by this signal and responds with a signal of its own. Either the same antenna that sends out the interrogation signal or other additional antennas can sense the signals from the EAS tag. If the EAS tag is not sensed within the zone created by the antennas, it is presumed that the article is being removed without purchase, and alarms are set off. These alarms may be audible alarms for general broadcast, silent alarms in the form of a light at a check-out counter or security station, and the like.

According to an embodiment of the invention the alarm system comprises a personnel tag, i.e. a tag identified to the personnel of the facility and carried by each member of the personnel. In this embodiment, the system may only allow removal of the EAS tag within an authorised area if the personnel tag is within a predetermined distance of the EAS tag. In this embodiment, the system may also allow removal of the EAS tag outside pre-defined authorised areas, i.e. the personnel tag may create an ad hoc-authorised area around itself.

The present invention also relates to a method for surveillance of sales items in a facility. In a typical method according to the invention each sales item is equipped with an electronic article surveillance tag and the facility is equipped with a location system. The electronic article surveillance tag communicates with the location system for checking the location of the electronic article surveillance tag if the means for sensing a magnetic field senses change in the magnetic field, or if the electrical coupling senses that the electrical connection is broken. In a typical method according to the invention the means for initiating an alarm initiate the alarm if the electronic article surveillance tag is outside a first authorised area.

According to an embodiment of the invention the location system installed in the facility utilizes the inputs from base stations and the signal transmitted by the EAS tag to determine the location of the EAS tag. According to another embodiment of the invention the location system and a monitoring system in association with a server system determine the location of the EAS tag and the article. The location system may use one or more base stations, and for example one base station may be equipped with two or more antennas, allowing a single base station to detect the location with sufficient accuracy.

According to an embodiment of the invention the first authorised area is the area of cash register. According to another embodiment of the invention the means for initiating an alarm initiate the alarm if the electronic article surveillance tag is outside a second authorised area. The second authorised area may be, for example, the area of the facility. According to another embodiment of the invention the second authorised area is an area outside the facility or the area inside the facility where the removal of the EAS tag is not allowed.

According to an embodiment of the invention the electromechanical construction of the EAS tag allows the same EAS tag body to be used with the pin type attachment configuration and the lanyard type attachment configuration.

The exemplary embodiments of the invention presented in this text are not interpreted to pose limitations to the applicability of the appended claims. The verb "to comprise" is used in this text as an open limitation that does not exclude the existence of also unrecited features. The features recited in the dependent claims are mutually freely combinable unless otherwise explicitly stated.

DETAILED DESCRIPTION OF THE DRAWINGS

The same reference signs are used of the same or like components in different embodiments.

Figure 1:
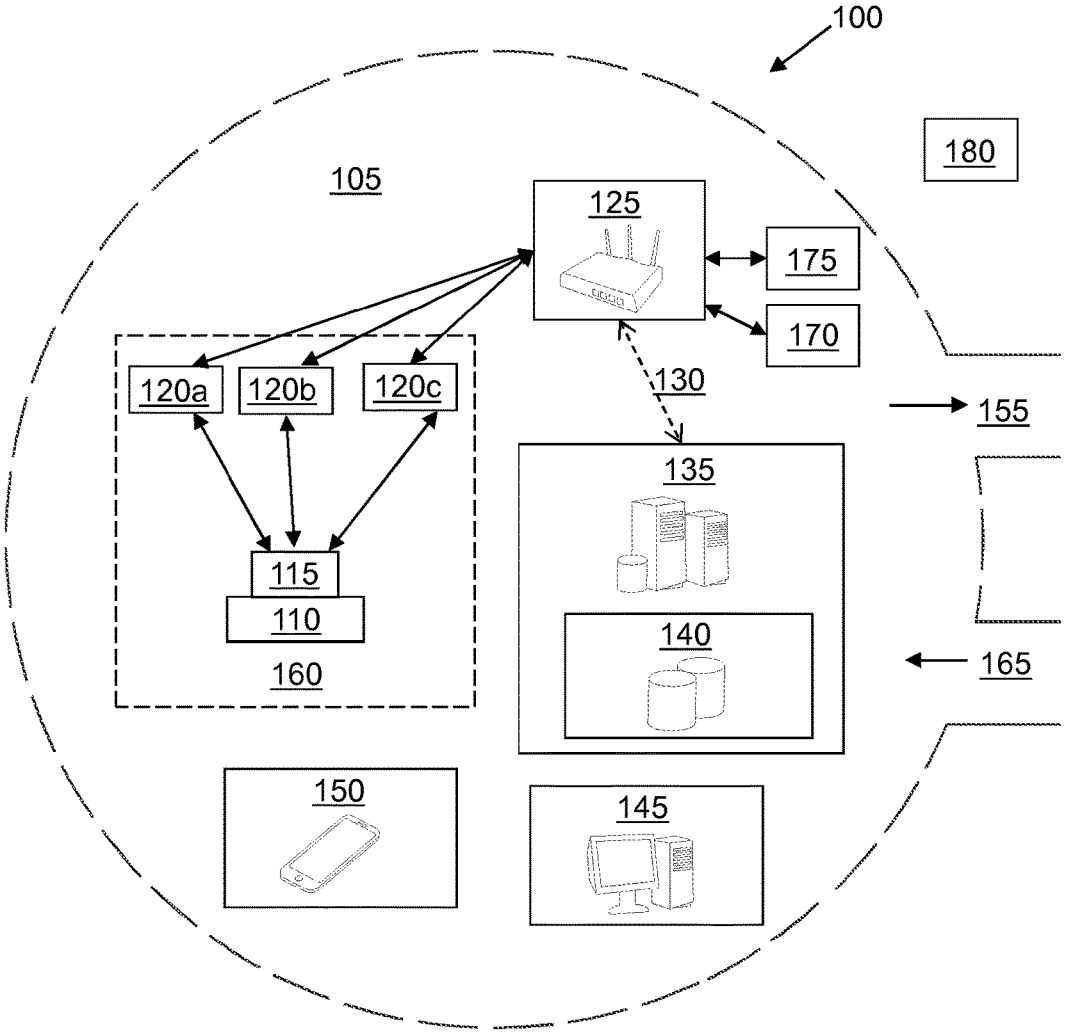
FIG. 1 illustrates an electronic article surveillance (EAS) system for surveillance of sales items according to an embodiment.

FIG. 1 illustrates an alarm system 100 in which various embodiments of the present invention can be practiced. The alarm system 100 is deployed in a facility 105.

An EAS tag 115 is attached to different articles, which require surveillance. For example, as shown in FIG. 1, the EAS tag 115 is attached to an article 110. The EAS tag 115 can be attached to the article 110 by locking fasteners.

The EAS tag 115 has a radio communication (such as Bluetooth low energy (BLE)) transmitter and the facility 105 has a base station 120*a*, a base station 120*b*, and a base station 120*c*. The base stations 120*a*, 120*b* and 120*c* receive the signals transmitted by the EAS tag 115. The signals transmitted by the EAS tag 115 enable determination of the location of the EAS tag 115 attached to the article 110. The base stations 120*a*, 120*b* and 120*c* in association with a location system 170 and a monitoring system 175 communicate the location via a router 125 to a server system 135 over a communication network 130, and the server system 135 in this embodiment includes a database 140. As is readily apparent to a person skilled in the art, the router 125 is not absolutely necessary for the functioning of the system 100. The server system 135 can be accessed by using communication devices, which include, for example, a laptop 145 and a mobile phone 150. FIG. 1 also shows a first authorised area 160, located inside the facility 105 where the removal of the EAS tag 115 is allowed, as well as a second area 180, where the removal of the EAS tag 115 triggers an alarm. Furthermore, one or more antennas can be placed at the exits 155 and entrances 165 to the facility 105.

It may be noted that FIG. 1 is shown to have the EAS tag 115 attached to the article 110; however, those skilled in the art would appreciate that the EAS tag 115 or similar EAS tags can be attached to different products. In addition, it may also be noted that the EAS system 100 can have more or less number of system components presently known in the art, which will enable the inventory control and theft control of different articles. For example, there can be multiple base stations/antennas and multiple allowable areas in the facility 105.

FIG. 2A, FIG. 2B, FIG. 2C and FIG. 2D illustrate an EAS tag 115 used in the EAS system 100 in accordance with various embodiments of the present system. It may be noted that to explain FIG. 2A, FIG. 2B, FIG. 2C and FIG. 2D, references will be made to the system elements of FIG. 1.

The EAS tag 115 is attached to the article 110 with a locking fastener/attaching mechanism. The locking fastener/attaching mechanism can utilize a pin based attaching element and a lanyard with pins as attaching elements. In other words, the EAS tag 115 is configured to be attached to the article 110 by either a pin based attaching element and/or a lanyard with pins as the attaching elements.

Referring to FIG. 2A, FIG. 2B, FIG. 2C and FIG. 2D, the EAS tag 115 has a body 205. The body 205 encapsulates different components of the EAS tag 115. The body 205 has an opening 210 and an opening 215 (as can be clearly seen in FIG. 2B). Each of the openings 210 and 215 is adapted to receive a pin 220 as an attaching mechanism. For example, to protect the article 110, the pin 220 is inserted into the opening 210. In context of the present application, the configuration in which the pin 220 is inserted in the EAS tag 115 is referred to as pin type attachment configuration.

Figure 2A:
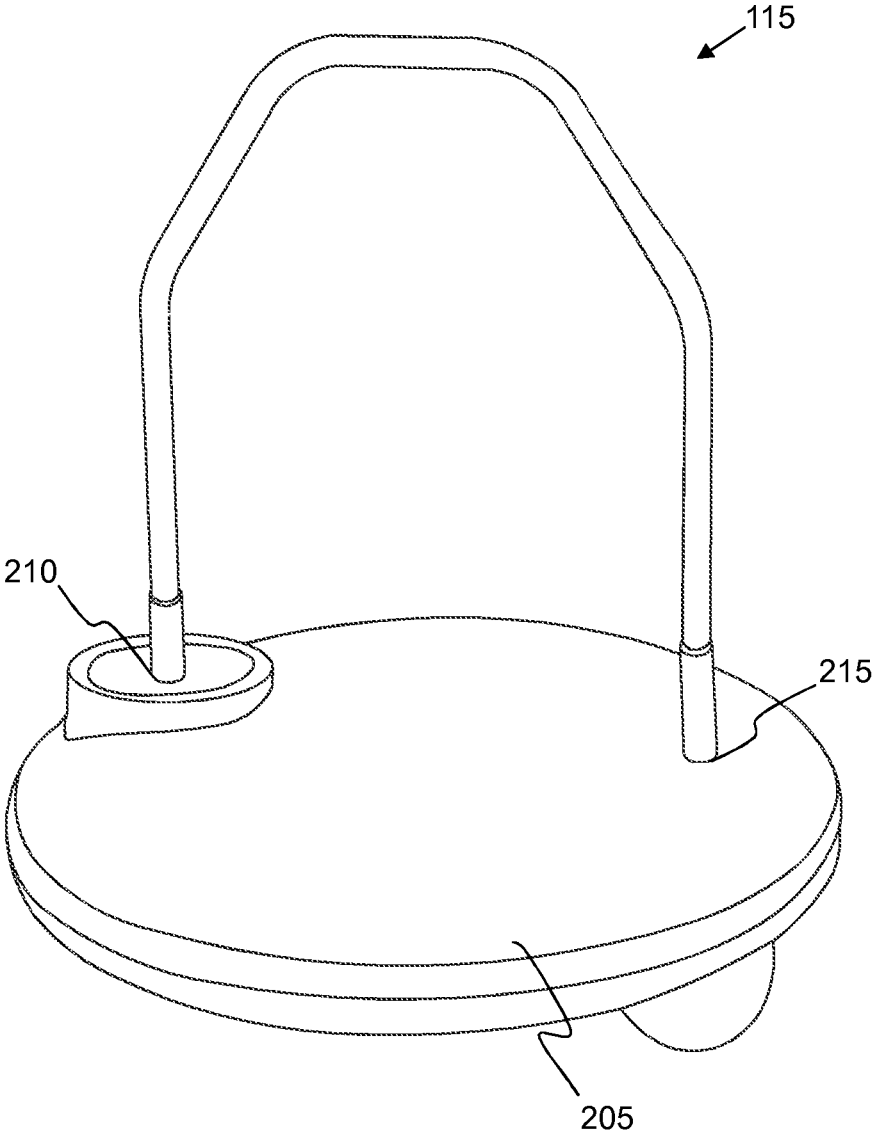
FIG. 2A illustrates a perspective view of an EAS tag used in the EAS system according to an embodiment.
Figure 2B:
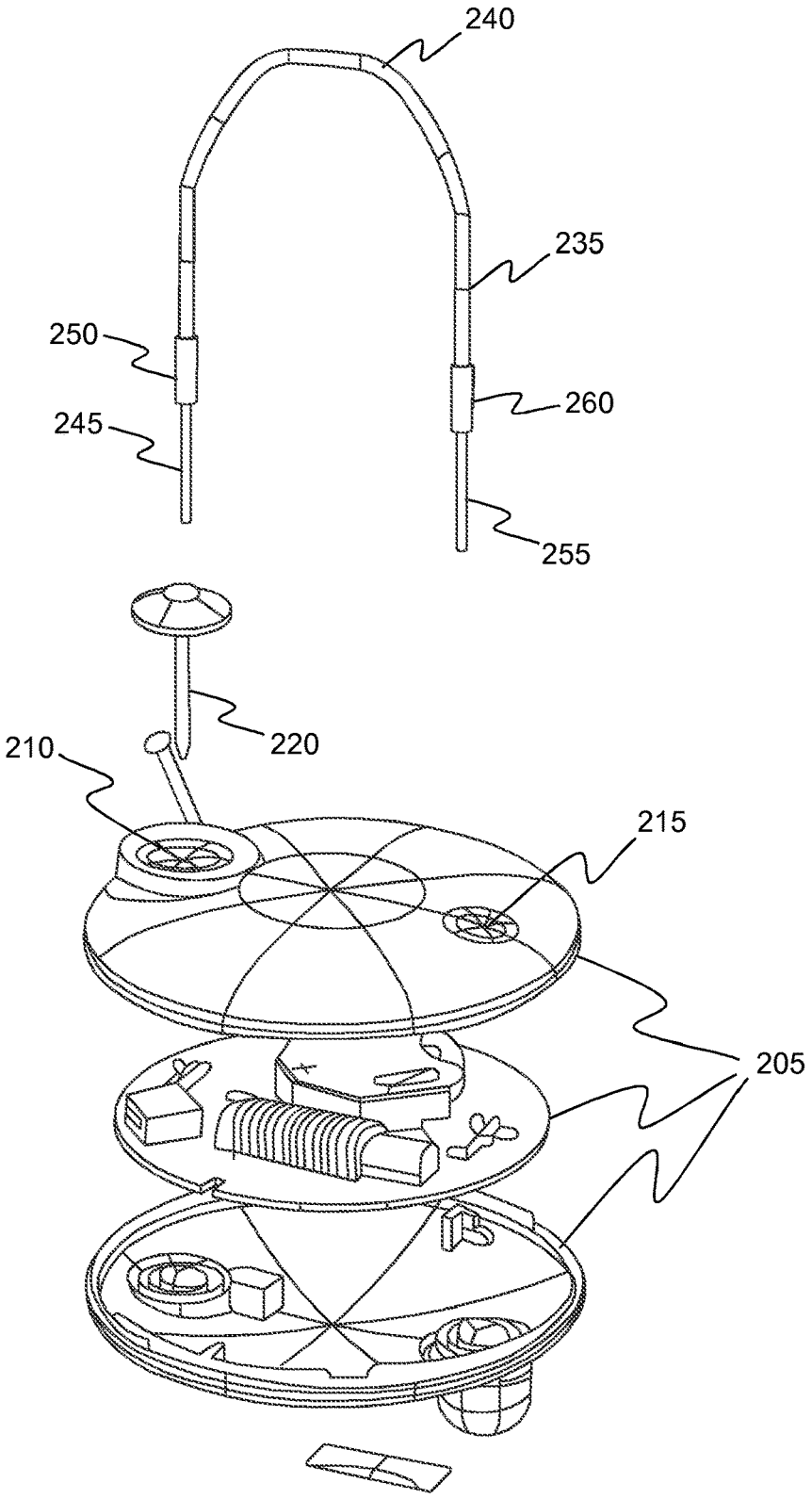
FIG. 2B, FIG. 2C and FIG. 2D illustrate an exploded view of the EAS tag used in the EAS system.
Figure 2C:
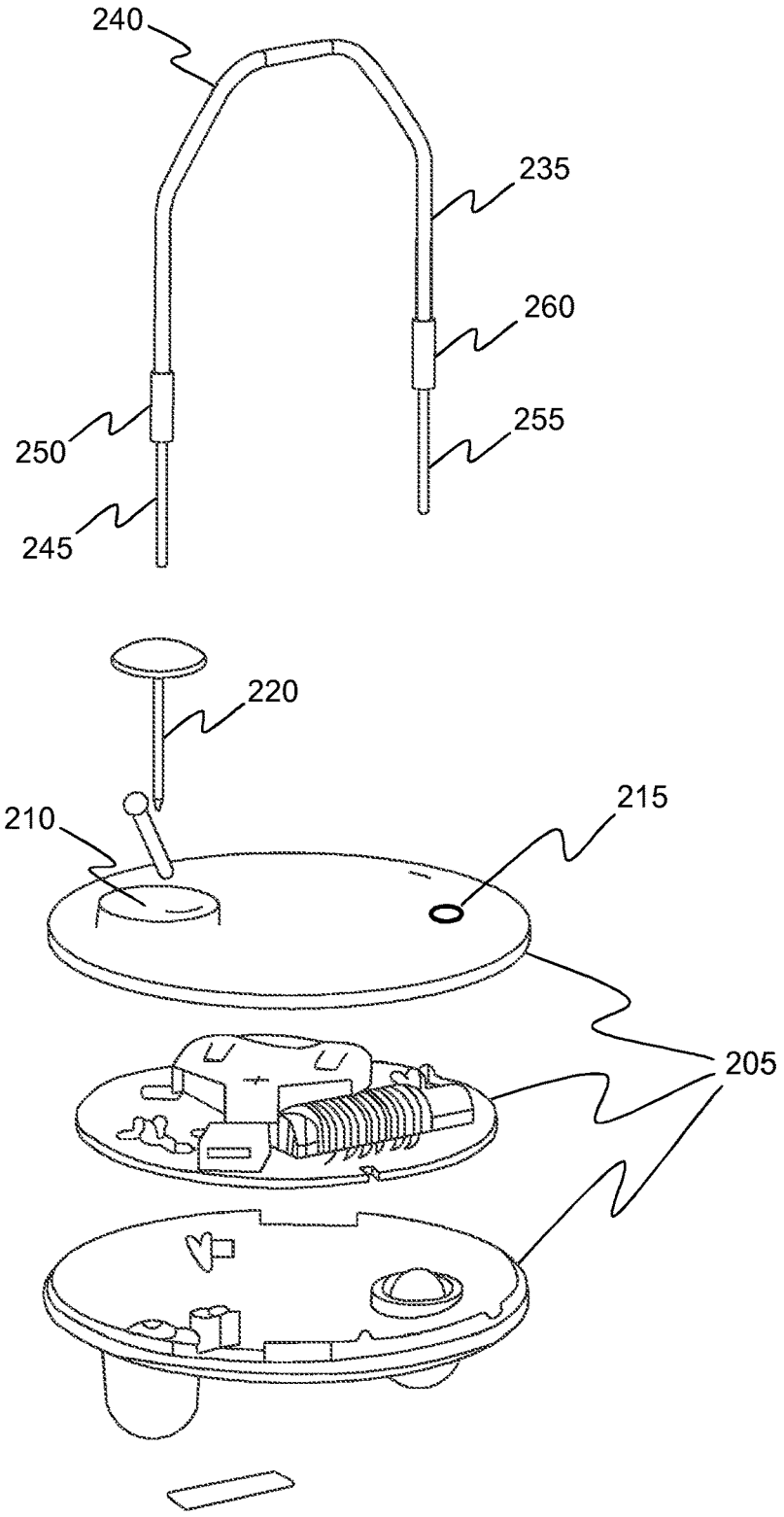
Figure 2D:
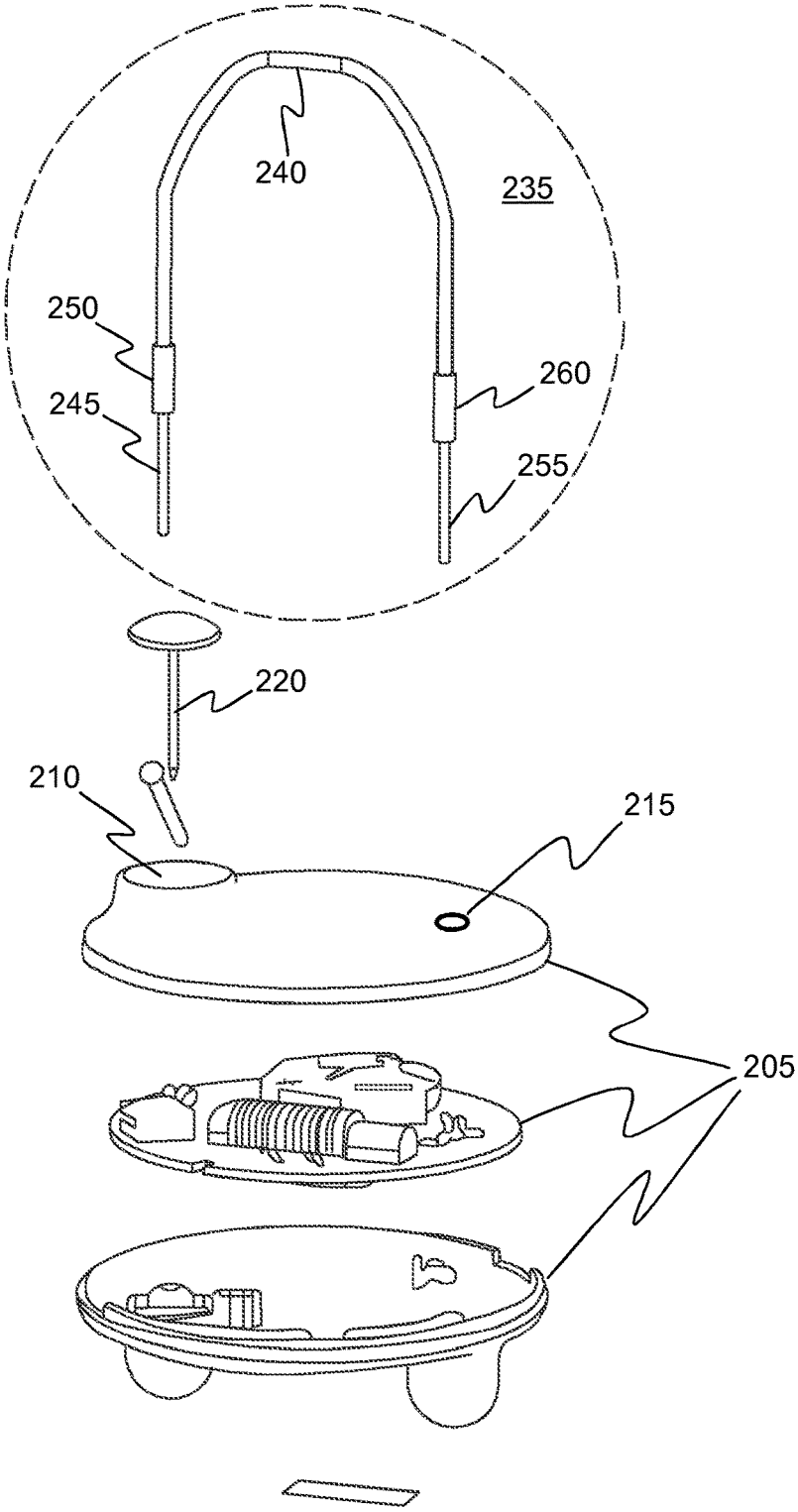

In addition, specifically referring to FIG. 2B, FIG. 2C and FIG. 2D, the opening 210 is adapted to receive a first end 245 of the lanyard 235 and the opening 215 is adapted to receive a second end 255 of the lanyard 235. The lanyard 235 includes a conducting wire 240. Both ends of the conducting wire 240 of the lanyard 235 have a pin shape head. For the sake of clarity and in order to explain the embodiments, a first end 245 of the conducting wire 240 of the lanyard 235 is shown to have a pin head 250 and a second end 255 of the conducting wire 240 of the lanyard 235 is shown to have a pin head 260.

In the context of the present application, the configuration in which the two ends 245 and 255 of the lanyard 235 are inserted into the openings 210 and 215 is referred to as lanyard type attachment configuration. The electro-mechanical construction of the EAS tag 115 allows the same EAS tag body 205 to be used with the pin type attachment (the pin type attachment configuration) and the lanyard type attachment configuration.

Figure 3A:
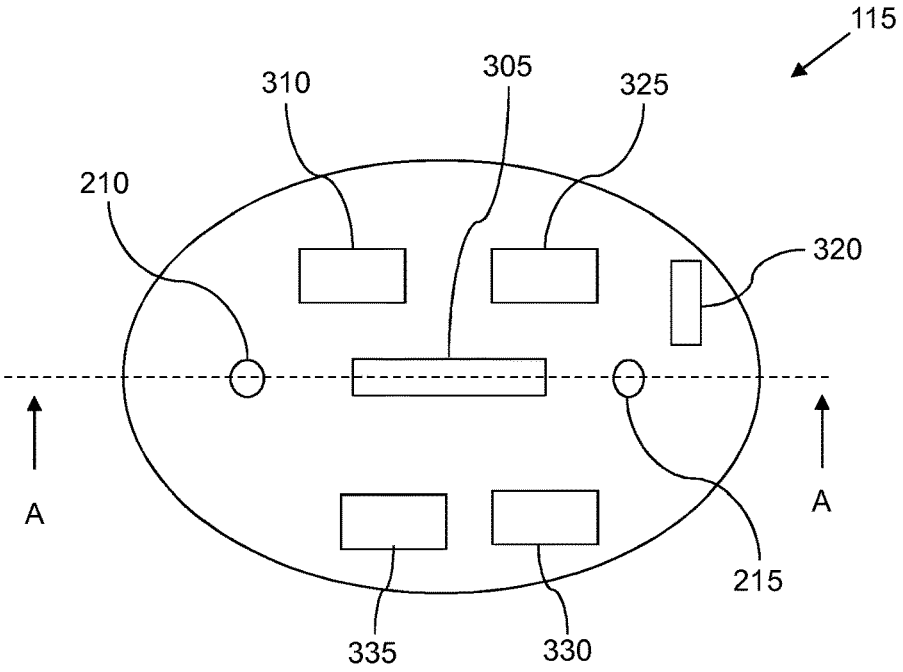
FIG. 3A, FIG. 3B, FIG. 4A, FIG. 4B and FIG. 4C illustrate different components of the EAS tag used in the EAS system according to an embodiment.
Figure 3B:
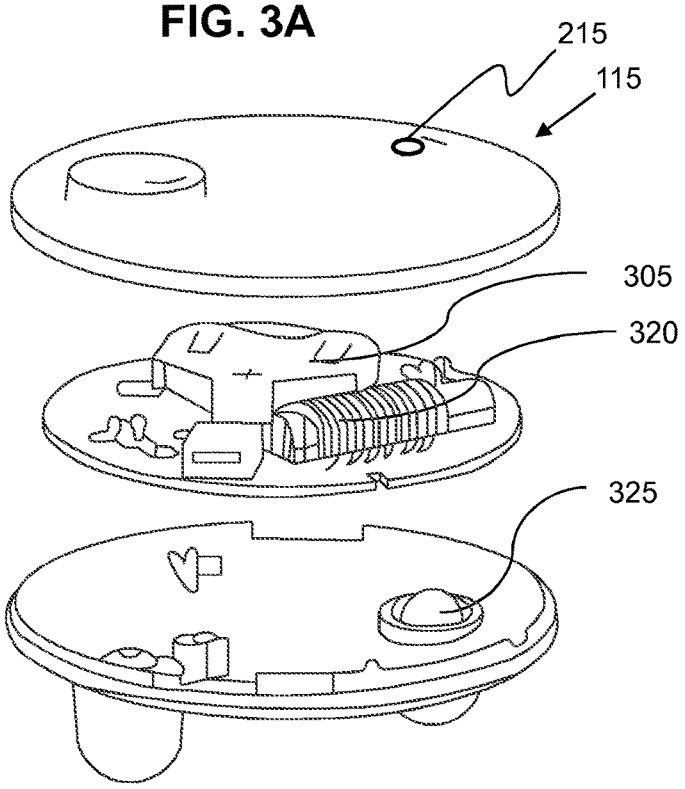

FIG. 3A and FIG. 3B illustrate a cross-sectional view and an isometric view respectively of the EAS tag 115, in accordance with various embodiments of the present invention. It may be noted that to explain FIG. 3, references will be made to the components shown in FIG. 1, FIG. 2A, FIG. 2B, FIG. 2C and FIG. 2D.

The body 205 of the EAS tag 115 encapsulates different components of the EAS tag 115, which in this embodiment include a sensor for sensing a magnetic field, a transceiver for communicating with a location system, a controller for allowing deactivation of the alarm function, an alarm device for initiating an alarm and the like.

Figure 4A:
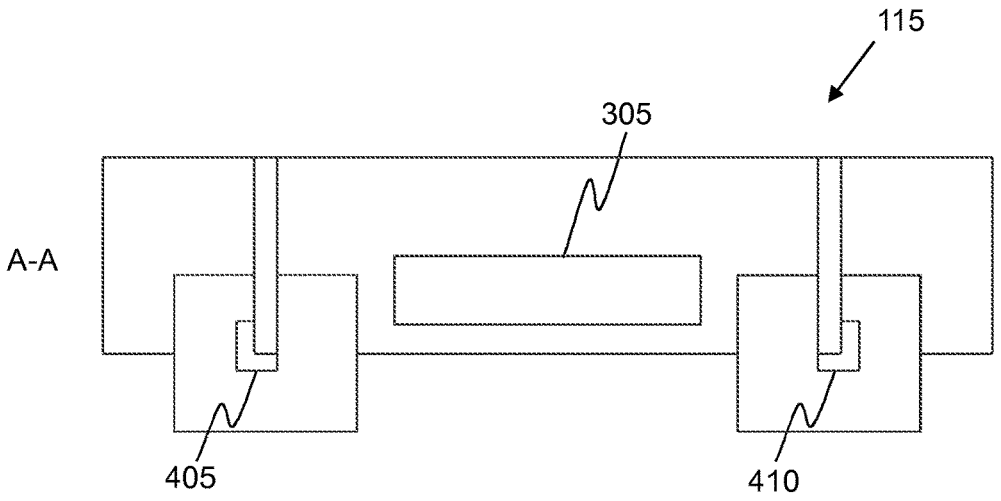
Figure 4B:
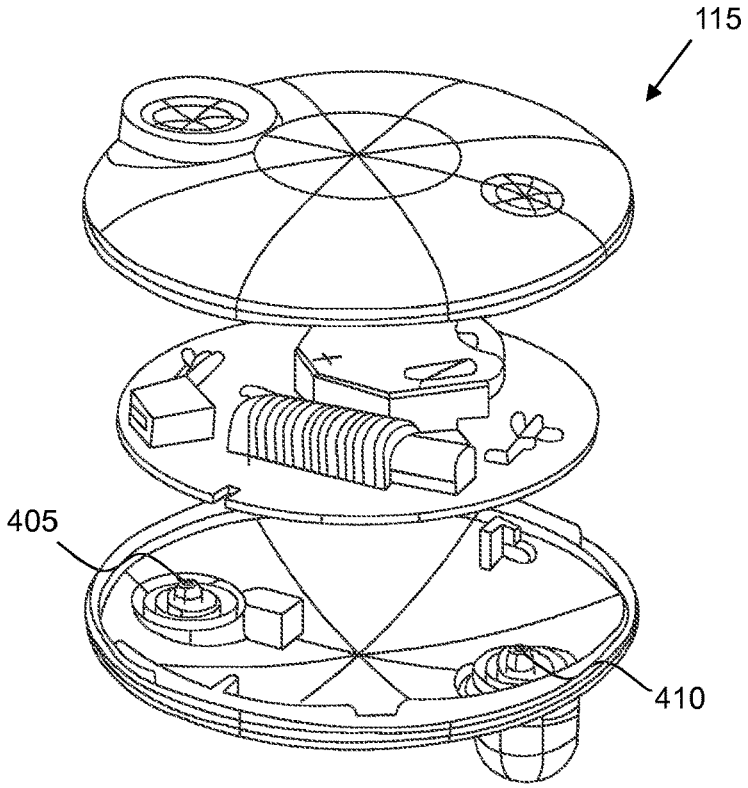
Figure 4C:
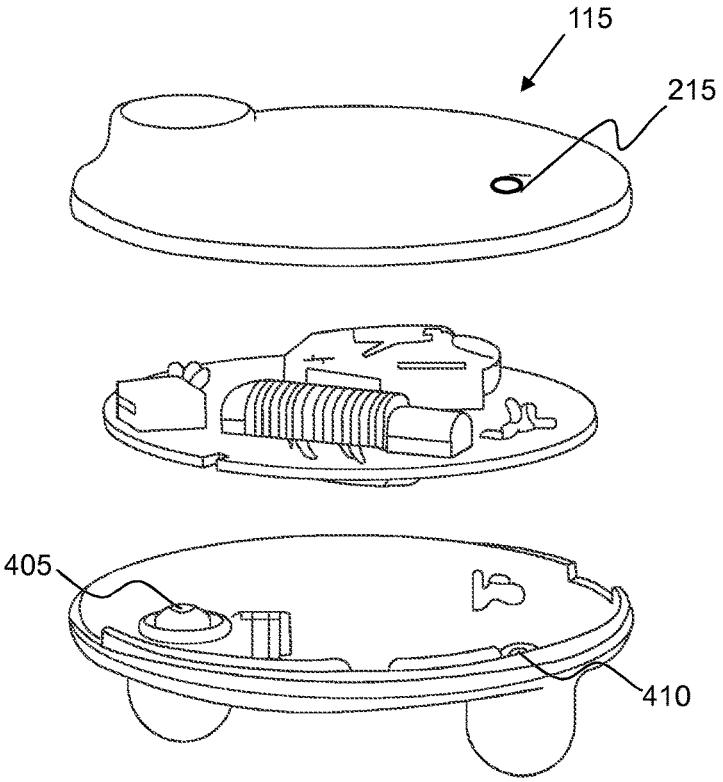

As shown in FIG. 3A and FIG. 3B (and also visible in FIG. 4A), the EAS tag 115 includes a battery holder 305, a battery 310 for providing electricity for the EAS tag 115, means for activating security gates at the exit (or entrance) of the facility 320, and a radio communication (such as Bluetooth low energy (BLE) or ultra wide band) module 325 for communication and location purposes.

In addition, as shown in FIG. 3A and FIG. 3B, the EAS tag 115 includes a local communication means such as a radio communication module 330 and a locking fastener 335.

Referring to FIG. 3A, FIG. 3B, FIG. 4A, FIG. 4B and FIG. 4C, the EAS tag 115 has the opening 210 and the opening 215 for inserting the pin 220 or the pin 250 at the first end 245 of the conducting wire 240 of the lanyard 235 and the pin 260 at the second end 255 of the conducting wire 240 of the lanyard 235 into the EAS tag 115. In the pin type attachment configuration, the inserted pin 220 is securely held with a locking mechanism 405. In the lanyard type attachment configuration, the pin 250 at the first end 245 of the conducting wire 240 of the lanyard 235 is securely held with the locking mechanism 405. Similarly, the pin 260 at the second end 255 of the conducting wire 240 of the lanyard 235 is securely held with the locking mechanism 410.

Figure 5:
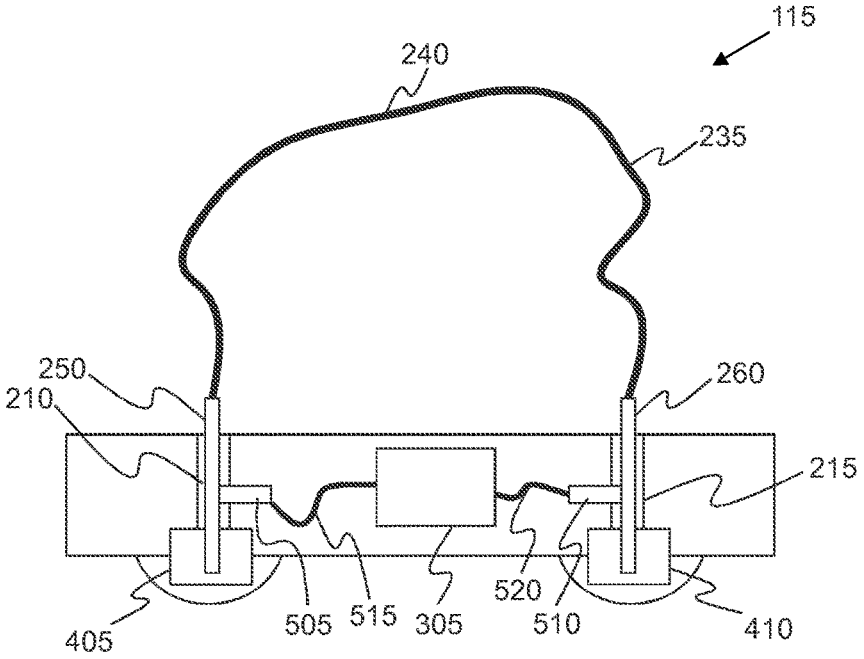
FIG. 5 is a side view of the EAS tag according to an embodiment when the lanyard is connected to the openings.

Referring to FIG. 5, the EAS tag 115 with the lanyard 235 connected to the openings 210 and 215 is illustrated. The lanyard 235 consists of the conducting wire 240, the pin 250 connected to the conducting wire 240 at the first end 245 and the pin 260 connected to the conducting wire 240 at the second end 255. The pin 250 is locked in the opening 210 with the locking mechanism 405. The locking mechanism 405 can be opened with a strong external magnet. The pin 260 is locked in the opening 215 with the locking mechanism 410. The locking mechanism 410 can be opened with the strong external magnet. A conductive element 505 is configured to be in contact with the pin 250 when the lanyard 235 is used as an attaching element. Similarly, a conductive element 510 is configured to be in contact with the pin 260. The conductive elements 505 and 510 are connected with wires 515 and 520 respectively to the microcontroller 305. The microcontroller 305 is configured to monitor whether the connection is made via the lanyard 235.

Figure 6:
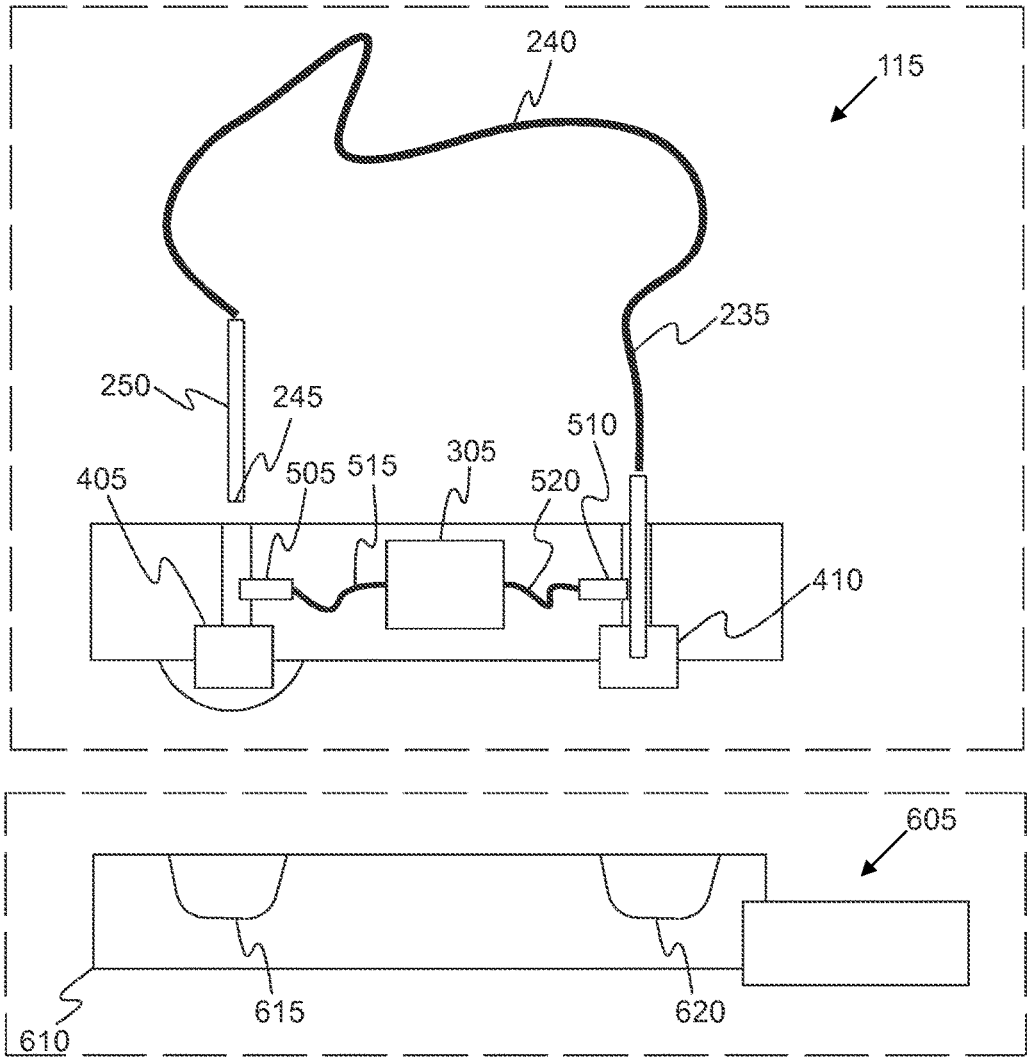
FIG. 6 illustrates a side view of the EAS tag according to an embodiment when a pin of the lanyard is removed from the EAS tag by an external detacher device.

FIG. 6 illustrates the EAS tag 115 when the pin 250 of the lanyard 235 is removed from the EAS tag 115 by an external detacher device 605. The detacher device 605 includes an external magnet 610. The external magnet 610 can be configured to have cavities 615 and 620 in order to mechanically correspond to size and form factor of the EAS tag 115. The number of cavities can be one or more. The pin 250 of the lanyard 235 can be removed when the EAS tag 115 is in contact or in close proximity of the external magnet 610. The external magnet 610 can be associated with the RFID reader, a Bluetooth receiver and the like that can be used to verify that the unlocking of the locking mechanism 410 and the locking mechanism 405 is allowed.

In an embodiment, the reed relay 335 in the electromagnetic circuitry of the EAS tag 115 senses non-authorised usage of the external magnet 610. In case of an unauthorised removal, the reed relay 335 activates to sense strong electromagnetic field and triggers an alarm of the sound source 320. The alarm from the sound source 320 is not triggered if a location detector in the EAS tag 115 informs that the EAS tag 115 is in an authorized place. For example, the radio communication (such as Bluetooth low energy (BLE) or ultra wide band) module 325 in association with the base stations 120*a*, 120*b* and 120*c*, the location system 170, the monitoring system 175 and the server system 135 can detect the location.

Figure 7:
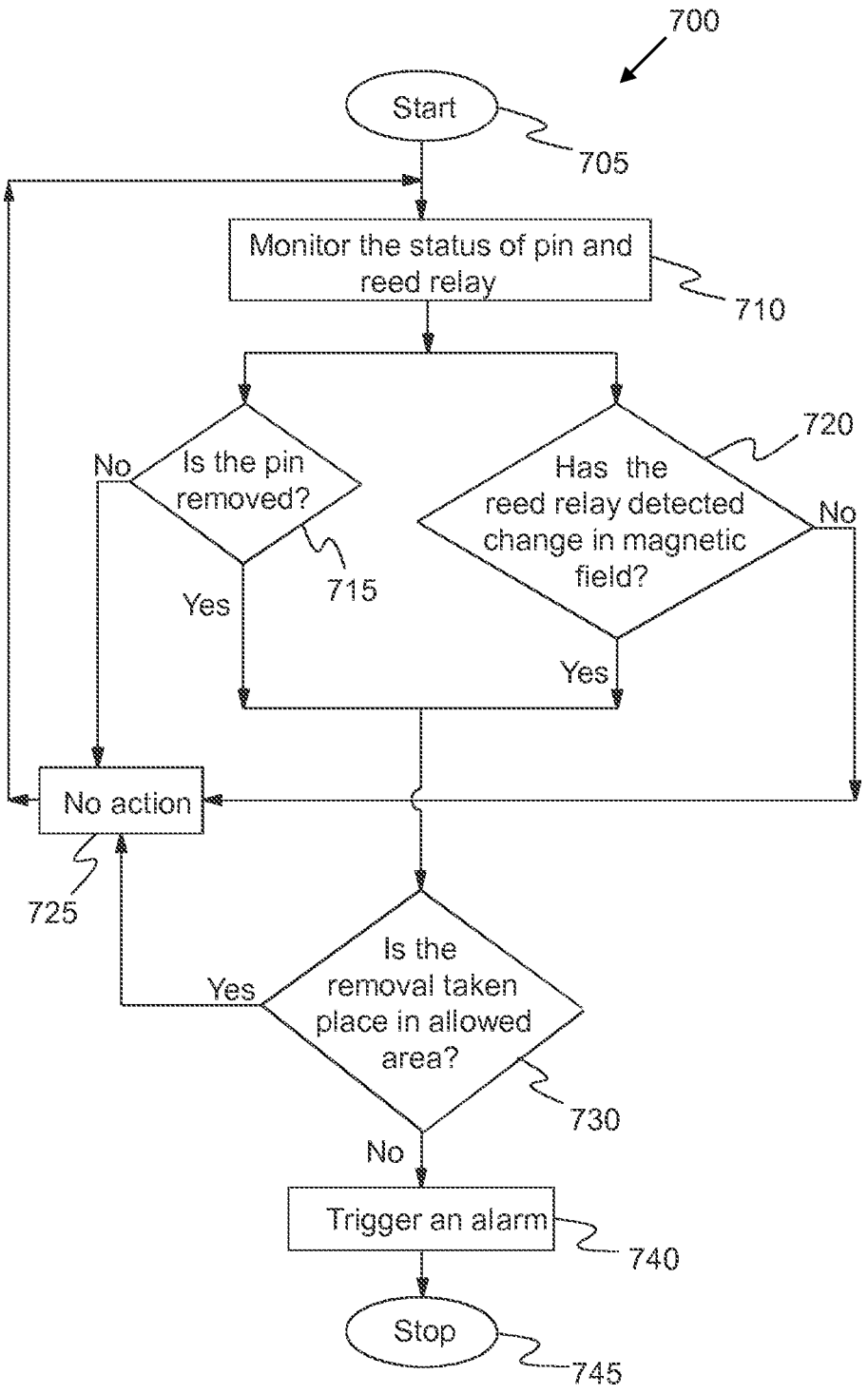
FIG. 7 illustrates a flowchart to show the operational process steps of the EAS tag according to an embodiment when used with the pin.

FIG. 7 illustrates a flowchart 700 to show the operational process steps of the EAS tag 115 when used with the pin 220, in accordance with various embodiments of the present invention. The flowchart 700 initiates at step 705. An operator inserts the pin 220 in the opening 210 of the EAS tag 115 to attach the article 110 with the EAS tag 115. At step 710, the status of the pin 220 and status of the reed relay 335 is monitored. If there is any change in the status of the pin 220 and the reed relay 335, then each of the status of the pin 220 and the reed relay 235 is monitored separately. As shown in step 715, the microcontroller 305 checks the removal of the pin 220. If the pin 220 is found to be not removed, then no action takes place (shown as step 725). However, if the pin 220 is found to be removed, the microcontroller 305 in communication with the base stations 120*a*, 120*b* and 120*c*, the monitoring system 175 and the location system 170 checks whether the removal is in the allowed area 160 (shown as step 730). If the removal of the pin 220 is performed in the allowed area 160, then no action takes place (shown as step 725). However, if the pin 220 is not removed in the allowed area 160, the alarm triggers (shown as step 740). Similarly, as shown in step 720, the microcontroller 305 checks whether the reed relay 335 detected any change in the magnetic field. If the change in the magnetic field has not taken place, then no action takes place (shown as step 725). However, if the change in the magnetic field has not taken place in the reed relay 335, the microcontroller 305 in communication with the base stations 120*a*, 120*b* and 120*c*, the monitoring system 175 and the location system 170 checks whether the change in magnetic field has taken place in the allowed area 160 (shown as step 730). If the change is taken place in the allowed area 160, then no action takes place (shown as step 725). However, if the change is performed in the allowed area 160, the alarm triggers (shown as step 740). The flowchart 700 terminates at step 745.

Figure 8:
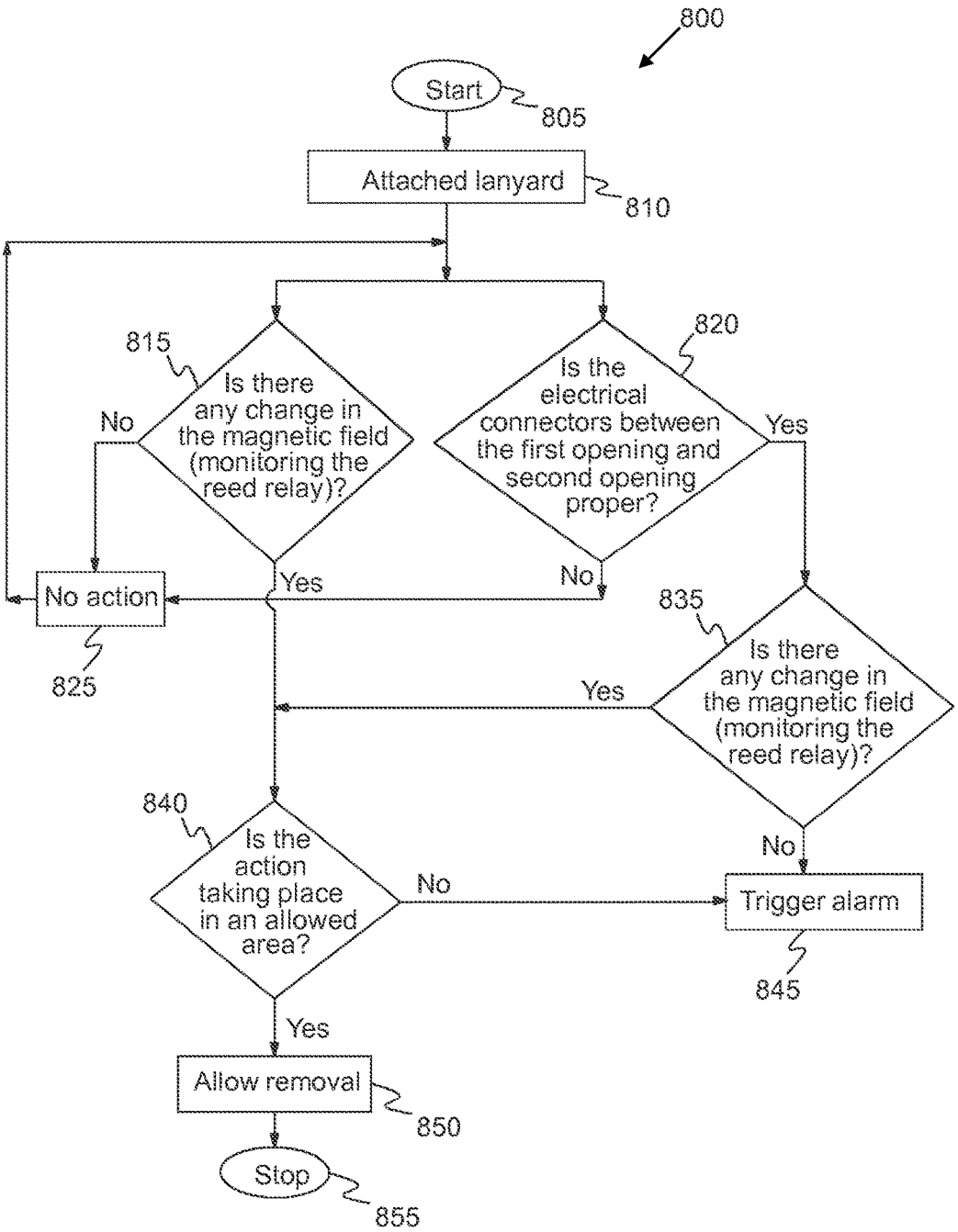
FIG. 8 illustrates a flowchart to show the operational process steps of the EAS tag according to an embodiment when used with the lanyard connected to the openings.

FIG. 8 illustrates a flowchart 800 to show the operational process steps of the EAS tag 115 when used with the lanyard 235 connected to the openings 210 and 215, in accordance with various embodiments of the present invention. At step 805, the flowchart 800 initiates. At step 810, the operator inserts the pin 250 at the first end 245 of the conducting wire 240 of the lanyard 235 and the pin 260 at the second end 255 of the conducting wire 240 of the lanyard 235 into the EAS tag 115.

At step 815, the reed relay 335 is monitored. If the reed relay 335 does not detect an external magnetic field, then no action takes place (shown in step 825). If the reed relay 335 detects the external field, the microcontroller 305 in association with the base station 120*a-c*, the monitoring system 175 and the location system 110 detects whether the EAS tag 115 is in an allowed area 160 (shown as step 840). If the EAS tag 115 is in the allowed area 160, the lanyard 235 is allowed to be removed (shown as step 850). If the EAS tag 215 is not in the allowed area 160, the alarm is triggered (shown as step 845).

On the other hand, at step 820, the microcontroller 305 monitors the electrical connection between the openings 210 and 215. If the electrical connection between the openings 210 and 215 is proper (detected i.e. the lanyard connects electricity between the openings 210 and 215), no action takes place (shown as step 825). If the electrical connection between the openings 210 and 215 is found to be improper (disconnected), the microcontroller 335 monitors the reed relay 335 (shown as step 835). If the reed relay 335 does not monitor change in the magnetic field but the connection is lost between the openings 210 and 215, the alarm triggers (shown as step 845), provided that the item is outside an authorised area and/or a personnel tag is not within the pre-defined distance or the item. Optionally prior to triggering the alarm the system can be configured to detect if the EAS tag 115 is in the allowed area 160 or not as further step. The lack of magnetic field in this case indicates that the lanyard 235 had been cut broken. If the reed relay 335 monitors a magnetic field, the microcontroller 305 in association with the base station 120*a-c*, the monitoring system 175 and the location system 170 detects whether the EAS tag 115 is in the allowed area 160 (shown as step 840). If the EAS tag 115 is not found to be in the allowed area 160, the alarm is triggered (shown as step 845). If the EAS tag 115 is in the allowed area 160, the lanyard 235 is allowed to be removed (shown as step 850). The flowchart 800 terminates at step 855.

The steps 705 to 745 of the flowchart 700 and the steps 805 to 855 of the flowchart 800 are only illustrative and other alternatives can also be provided where one or more steps are added, one or more steps are removed, or one or more steps are provided in a different sequence without departing from the scope of the claims herein.

Figure 9:
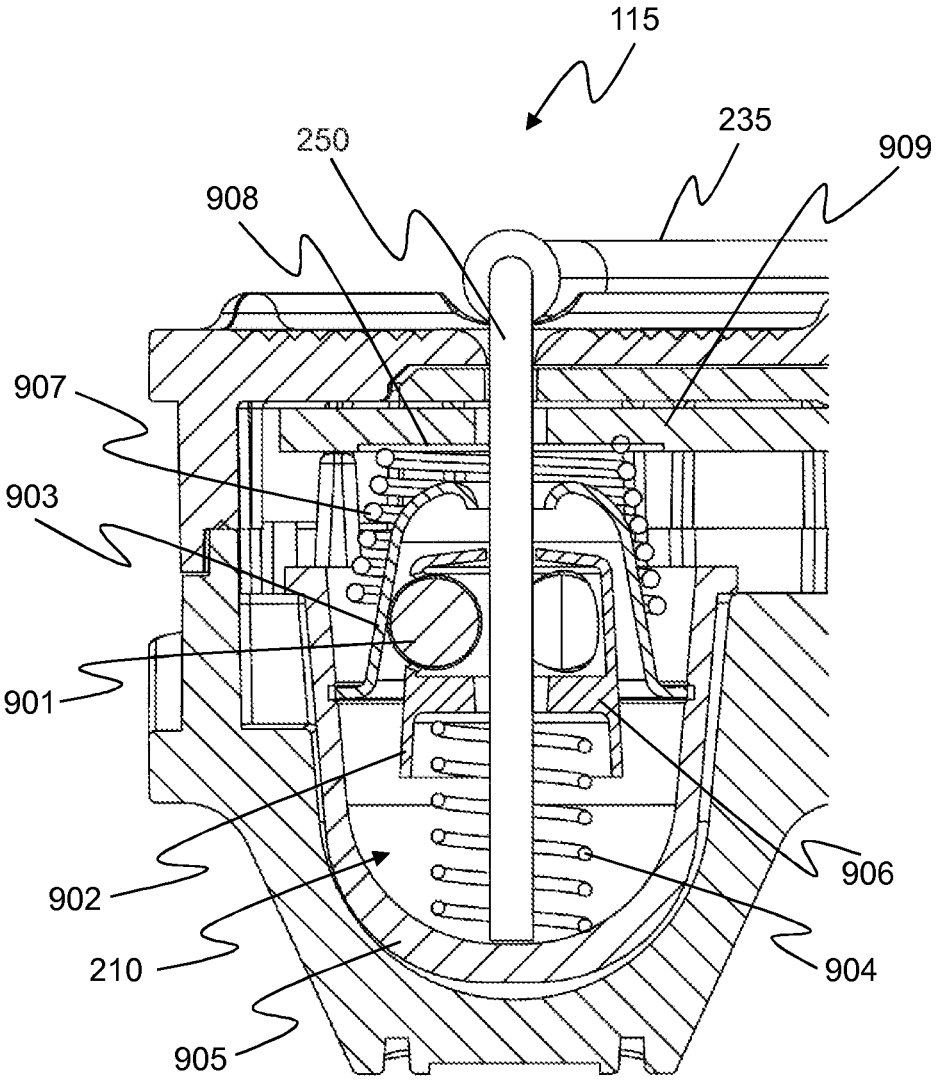
FIG. 9 illustrates a partial cross-sectional view of an EAS tag according to an embodiment.

FIG. 9 illustrates a partial cross-sectional view of an EAS tag 115 according to an embodiment of the invention. In FIG. 9, there is shown only one opening 210 of the EAS tag 115, into which opening 210 a pin 250 of a lanyard 235 has been inserted. The pin 250 is locked in the opening 210 with a locking mechanism that comprises a plurality of balls 901, which are supported by a ball cage 902, a cone shaped cup 903 that is arranged in contact with the balls 901, and a coil spring 904 that supports the ball cage 902 into the cone shaped cup 903. The cone shaped cup 903 is open at the large end of the cone and attached to an outer cap 905. The cone shaped cup 903 has an aperture at the small end of the cone through which the pin 250 is inserted. The ball cage 902 is cylindrical and sized to fit inside the cone shaped cup 903. The ball cage 902 has apertures for admitting the balls 901 into the inner space of the ball cage 902. The ball cage 902 has also an aperture for receiving the pin 250 at the top of its axis. The ball cage 902 with the balls 901 is assembled in the cone shaped cup 903, so that the balls 901 have a contact with the inner surface of the cone shaped cup 903. This contact with the electrically conductive material of the cone shaped cup 903 and the balls 901 ensures the electrical connection between them. The coil spring 904 is assembled between the bottom of the outer cap 905 and a spring plate 906 of the ball cage 902 in order to support the ball cage 902 into the cone shaped cup 903 when inserting or releasing the pin 250. The locking mechanism also comprises another coil spring 907, a first end of which is arranged in contact with the cone shaped cup 903 and a second end of which is arranged in contact with a contact pad 908 of a circuit board 909. The coil spring 907 enables to convey electrical current between the cone shaped cup 903 and the contact pad 908.

Figure 10:
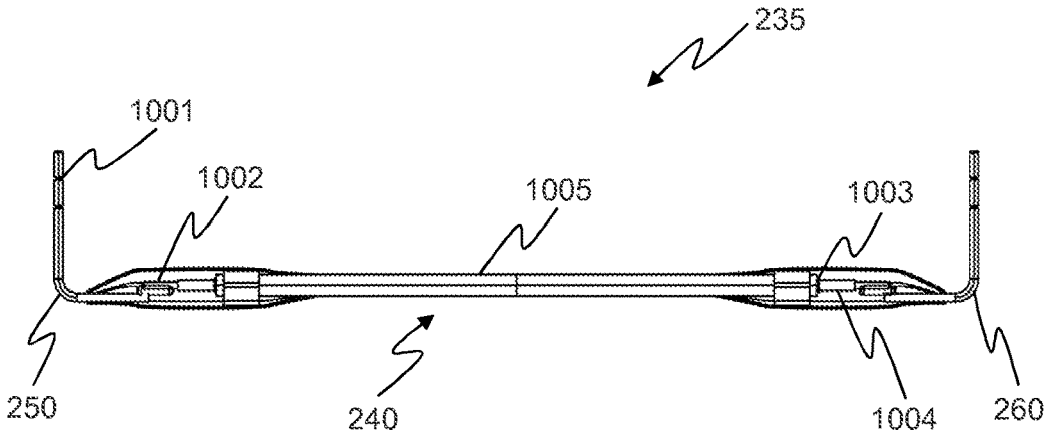
FIG. 10 illustrates a cross-sectional view of a lanyard that can be used in an EAS tag according to an embodiment.

FIG. 10 illustrates a cross-sectional view of a lanyard 235 that can be used in an EAS tag 115 according to an embodiment of the invention. The lanyard 235 comprises a conducting wire 240 that is connected at its ends to the pins 250 and 260. The pins 250 and 260 are bent at an angle of about 90 degrees, i.e. to an essentially right angle. The pins 250 and 260, which are meant to be inserted into the openings 210 and 215 of the body 205, comprise grooves 1001 for engaging with the locking mechanisms 405 and 410 in the openings 210 and 215.

The conducting wire 240 comprises an inner conductor 1002 and an outer conductor 1003, which are electrically isolated from each other by an insulating layer 1004. The outer conductor 1003 is surrounded by an insulating outer sheath 1005. The inner conductor 1002 is electrically connected at its first end to the pin 250 and at its second end to the pin 260 so that electrical current may be conducted through the lanyard 235. The inner conductor 1002 is connected to the pins 250 and 260 by soldering. The outer conductor 1003, which is electrically isolated from the inner conductor 1002 and the pins 250 and 260, makes it difficult to cut the lanyard 235 without the cutting being detected because a bypass wire (not shown in FIG. 10) cannot be coupled to the inner conductor 1002 without at the same time coupling the inner conductor 1002 through the bypass wire to the outer conductor 1003. This coupling causes measurable changes in the electrical current that is conveyed through the lanyard 235.

Figure 11:
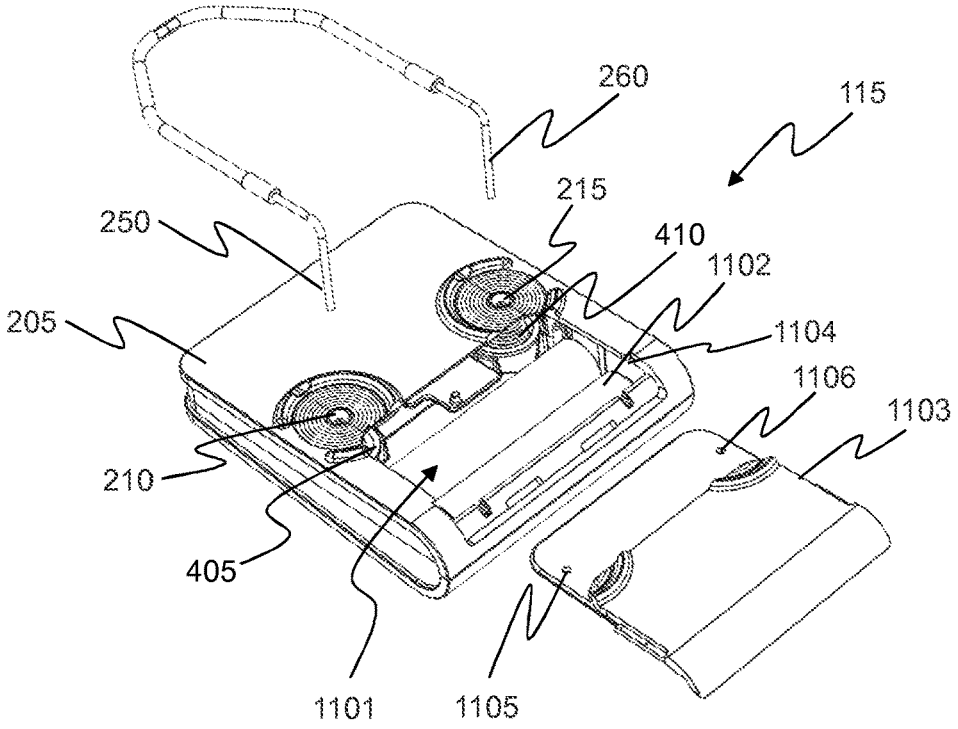
FIG. 11 illustrates a perspective view of an EAS tag according to an embodiment.

FIG. 11 illustrates a perspective view of an EAS tag 115 according to an embodiment of the invention. The EAS tag 115 comprises a body 205 that is provided with a battery compartment 1101 for holding batteries 1102. The body 205 comprises openings 210 and 215, through which pins 250 and 260, respectively, can be inserted inside the body 205. The pins 250 and 260 can be locked to the EAS tag 115 by locking mechanisms 405 and 410, respectively.

The EAS tag 115 comprises a slidable cover 1103 for closing the battery compartment 1101. The slidable cover 1103 is attachable to the body 205 in a slidable manner along grooves 1104 on the edge of the battery compartment 1101. The slidable cover 1103 comprises openings 1105 and 1106, which are aligned with the openings 210 and 215, respectively, when the slidable cover 1103 is in the closed position, i.e. when the slidable cover 1103 covers the opening of the battery compartment 1101. The openings 210, 215, 1105 and 1106 are round through-holes.

When the slidable cover 1103 is in the closed position, the pin 250 can be inserted through the openings 210 and 1105 into the body 205 and locked therein by the locking mechanism 405 and the pin 260 can be inserted through the openings 215 and 1106 into the body 205 and locked therein by the locking mechanism 410. The pins 250 and 260 that have been inserted through the openings 1105 and 1106, respectively, inside the body 205 prevent the slidable cover 1103 from being detached from the body 205 and thus they prevent an unauthorized removal of the batteries 1102 from the EAS tag 115.

Figure 12:
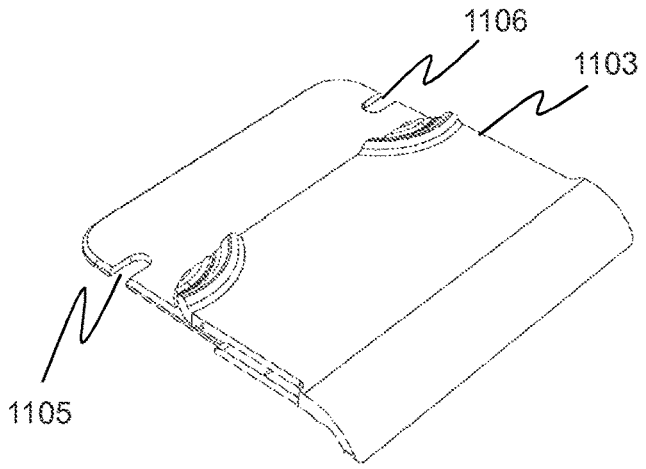
FIG. 12 illustrates an alternative slidable cover for the EAS tag according to FIG. 11.

FIG. 12 illustrates an alternative slidable cover for the EAS tag according to FIG. 11. The openings 1105 and 1106 of the slidable cover 1103 are openings that extend from the edge towards the center of the slidable cover 1103 in a direction perpendicular to the movement direction of the slidable cover 1103.

Figure 13:
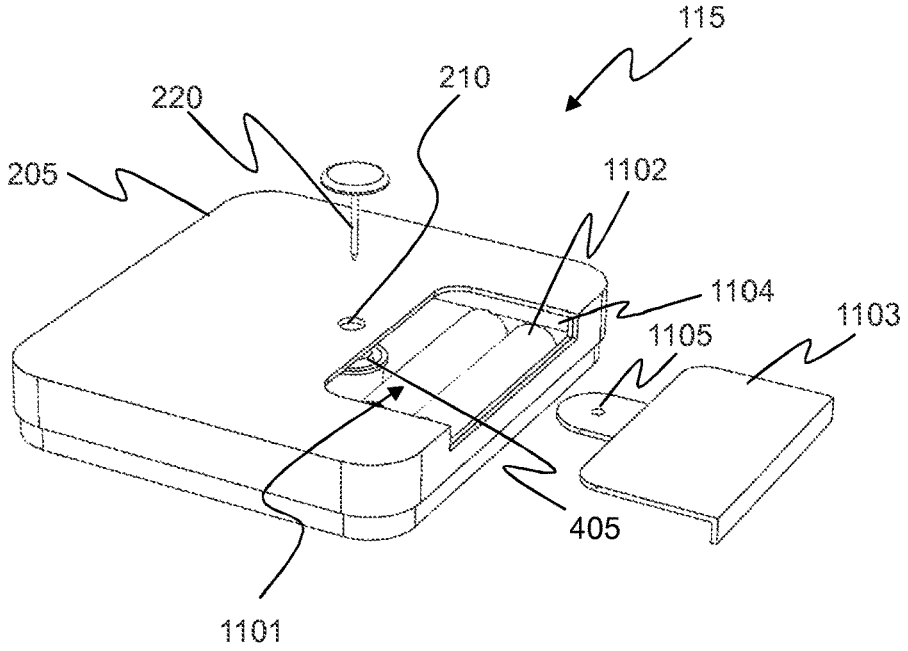
FIG. 13 illustrates a perspective view of an EAS tag according to an embodiment.

FIG. 13 illustrates a perspective view of an EAS tag 115 according to an embodiment of the invention. The EAS tag 115 comprises a body 205 that is provided with a battery compartment 1101 for holding batteries 1102. The body 205 comprises an opening 210 through which a pin 220 can be inserted inside the body 205. The pin 220 can be locked to the EAS tag 115 by a locking mechanism 405.

The EAS tag 115 comprises a slidable cover 1103 for closing the battery compartment 1101. The slidable cover 1103 is attachable to the body 205 in a slidable manner along grooves 1104 on the edge of the battery compartment 1101. The slidable cover 1103 comprises an opening 1105, which is aligned with the opening 210, when the slidable cover 1103 is in the closed position. The openings 210 and 1105 are round through-holes.

When the slidable cover 1103 is in the closed position, the pin 220 can be inserted through the openings 210 and 1105 into the body 205 and locked therein by the locking mechanism 405. The pin 220 that has been inserted through the opening 1105 inside the body 205 prevents the slidable cover 1103 from being detached from the body 205 and thus it prevents an unauthorized removal of the batteries 1102 from the EAS tag 115.

Figure 14:
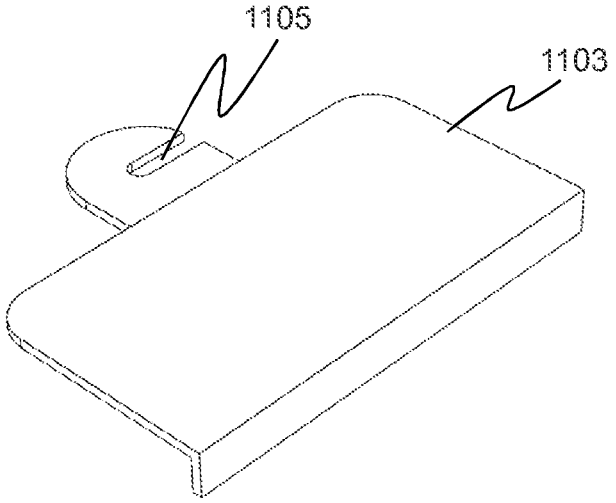
FIG. 14 illustrates an alternative slidable cover for the EAS tag according to FIG. 13.

FIG. 14 illustrates an alternative slidable cover for the EAS tag according to FIG. 13. The opening 1105 of the slidable cover 1103 is an opening that extends from the edge towards the center of the slidable cover 1103 in a direction perpendicular to the movement direction of the slidable cover 1103.

Only advantageous exemplary embodiments of the invention are described in the figures. It is clear to a person skilled in the art that the invention is not restricted only to the examples presented above, but the invention may vary within the limits of the claims presented hereafter. Some possible embodiments of the invention are described in the dependent claims, and they are not to be considered to restrict the scope of protection of the invention as such.

The invention claimed is:

1. An electronic article surveillance tag, comprising:

a body provided with a battery compartment for holding a battery, the body comprising a first opening through which an end of a first pin can be inserted inside the body and releasably locked therein by a first locking mechanism, wherein the electronic article surveillance tag comprises a slidable cover for closing the battery compartment, the slidable cover comprising a second opening that is aligned with the first opening when the slidable cover is in a closed position, wherein the body comprises a third opening through which an end of a second pin can be inserted inside the body and releasably locked therein by a second locking mechanism, and the slidable cover comprises a fourth opening that is aligned with the third opening when the slidable cover is in a closed position.

2. The electronic article surveillance tag according to claim 1, wherein the electronic article surveillance tag comprises a detector for detecting whether at least the first locking mechanism is locked to the first pin and the second locking mechanism is locked to the second pin.

3. The electronic article surveillance tag according to claim 1, wherein the electronic article surveillance tag comprises at least a first pin lockable to the electronic article surveillance tag with the first locking mechanism and a second pin lockable to the electronic article surveillance tag with the second locking mechanism.

4. The electronic article surveillance tag according to claim 1, wherein the first locking mechanism and the second locking mechanism are electrically coupled to each other via an electrical coupling within the body, the electrical coupling being configured to detect if electrical current can be conveyed outside the body from one locking mechanism to the other.

5. The electronic article surveillance tag according to claim 4, wherein the electronic article surveillance tag comprises a lanyard having a first pin at its first end and a second pin at its second end, the first pin being lockable to the electronic article surveillance tag with the first locking mechanism, and the second pin being lockable to the electronic article surveillance tag with the second locking mechanism.

6. The electronic article surveillance tag according to claim 5, wherein the lanyard comprises a conducting wire having an inner conductor that is electrically connected to the first and second pins.

7. The electronic article surveillance tag according to claim 6, wherein the conducting wire comprises an outer conductor arranged around the inner conductor, the outer conductor being electrically isolated from the inner conductor and the first and second pins.

8. The electronic article surveillance tag according to claim 5, wherein at least one of the pins of the lanyard is bent.

9. The electronic article surveillance tag according to claim 1, wherein the electronic article surveillance tag comprises a sensor for sensing a magnetic field.

10. The electronic article surveillance tag according to claim 9, wherein the sensor for sensing a magnetic field is selected from a group consisting of a reed relay and a magnetometer.

11. The electronic article surveillance tag according to claim 1, wherein the electronic article surveillance tag comprises:

a transceiver for communicating with a location system, a controller for allowing deactivation of an alarm function, and an alarm device for initiating an alarm.

12. The electronic article surveillance tag according to claim 11, wherein the transceiver for communicating comprises a radio communication module.

13. The electronic article surveillance tag according to claim 11, wherein the controller for allowing deactivation of the alarm function comprises an authorisation mechanism for deactivating the alarm function.

14. The electronic article surveillance tag according to claim 11, wherein the alarm device for initiating an alarm comprises a sound source for making an alarm.

15. An alarm system for a facility, comprising:

at least one electronic article surveillance tag including body provided with a battery compartment for holding a battery, the body comprising a first opening through which an end of a first pin can be inserted inside the body and releasably locked therein by a first locking mechanism, wherein the electronic article surveillance tag comprises a slidable cover for closing the battery compartment, the slidable cover comprising a second opening that is aligned with the first opening when the slidable cover is in a closed position, wherein the body comprises a third opening through which an end of a second pin can be inserted inside the body and releasably locked therein by a second locking mechanism, and the slidable cover comprises a fourth opening that is aligned with the third opening when the slidable cover is in a closed position, a location system of the facility, comprising a transceiver for communicating with the electronic article surveillance tag, and at least one alarm device selected from a group consisting of a silent alarm device and an audible alarm device.

* * * * *